US010143281B1

(12) United States Patent
Gardner

(10) Patent No.: US 10,143,281 B1
(45) Date of Patent: Dec. 4, 2018

(54) MODULAR ORGANIZATIONAL SYSTEM

(71) Applicant: Justin S. Gardner, Henderson, NV (US)

(72) Inventor: Justin S. Gardner, Henderson, NV (US)

( * ) Notice: Subject to any disclaimer, the term of this patent is extended or adjusted under 35 U.S.C. 154(b) by 0 days.

(21) Appl. No.: 15/843,308

(22) Filed: Dec. 15, 2017

(51) Int. Cl.
*A45C 13/03* (2006.01)
*A45C 5/03* (2006.01)
*A45C 13/02* (2006.01)

(52) U.S. Cl.
CPC ..... *A45C 13/03* (2013.01); *A45C 5/03* (2013.01); *A45C 2013/026* (2013.01)

(58) Field of Classification Search
CPC ..... A45C 2013/026; A45C 13/03; A45C 5/03
USPC ..... 220/532, 528, 4.28
See application file for complete search history.

(56) References Cited

U.S. PATENT DOCUMENTS 4,165,088 A * 8/1979 Nelson ..... B62B 3/02 280/47.35
4,889,253 A 12/1989 Schmulian et al.
5,118,173 A * 6/1992 Proctor ..... D06F 95/002 220/23.88
6,224,259 B1 * 5/2001 Guerra ..... D06F 95/006 383/117
7,779,976 B2 8/2010 Mangano
8,584,327 B1 * 11/2013 Kodak ..... A61G 17/0076 220/4.28
2007/0272719 A1 11/2007 Laughton
2012/0285124 A1 * 11/2012 Hagger ..... A45C 3/00 53/473
2015/0238032 A1 * 8/2015 Parks ..... A47G 21/14 220/528

* cited by examiner

*Primary Examiner* — Stephen Castellano
(74) *Attorney, Agent, or Firm* — Dale J. Ream

(57) ABSTRACT

A modular organizational system for use in organizing a suitcase includes an insert portion having opposed top and bottom panels a pair of opposed side panels extending between therebetween. The panels of the insert portion have inner surfaces that define spaced apart grooves. A plurality of primary panels includes upper and lower edges selectively received in the plurality of grooves of the top and bottom panels, each primary panel having an inner edge defining a plurality of slots. The system includes a plurality of auxiliary panels, each auxiliary panel having an outer edge defining a slot extending away therefrom configured for mating with a respective slot of a primary panel, respectively. A plurality of pegboard panels are attached to inward edges of the top, bottom, and side panels, respectively, the plurality of pegboard panels defining a plurality of spaced apart holes suitable for hanging articles.

15 Claims, 13 Drawing Sheets

MODULAR ORGANIZATIONAL SYSTEM

BACKGROUND OF THE INVENTION

The present invention relates generally to modular packing equipment and, more particularly, to a modular organization system for assembly and use in a suitcase or similar luggage. The modular organization system enables a traveler to organize and separate different clothing types and then to present and display them in the manner of a bedroom dresser at a travel destination.

Travelers typically pack clothing of many types, toiletries, and shoes in a suitcase or similar luggage and then travel to a destination location, such as a hotel or relative's home. Then, the traveler may unpack part or all of the contents of the suitcase and transfer the unpacked items into the drawers of a hotel dresser. Or, in some cases, a traveler may choose not to transfer his clothes from the suitcase to respective drawers but, instead, to just "live out of the suitcase" for the duration of his trip—especially if the traveler intends only a short stay. Inevitably, however, packed items easily and quickly become mixed together, disorganized, or even lost within the large interior area of a suitcase or in its multiple compartments.

Various organization systems for organizing a suitcase have been proposed. Although presumably effective for their intended use, the existing products or proposals do not enable a traveler to initially and effectively partition and organize the clothing and toiletries before traveling and then to orient the suitcase in a manner that enables the organized articles to be accessible in the manner of a dresser without ever having to unpack the suitcase.

Therefore, it would be desirable to have a modular organizational system for insertion into and use with a suitcase that enables a traveler to separate and organize different clothing types or toiletries prior to travel and, upon arrival at a destination, to orient the suitcase to present the packed items for use without any unpacking or reorganization. Further, it would be desirable to have a modular organizational system having an insert portion as a framework and a plurality of differently sized and configured panels for a traveler to customize virtually any size of suitcase to pack and present the packed articles.

SUMMARY OF THE INVENTION

A modular organizational system for use in organizing a suitcase according to the present invention includes an insert portion having a top panel opposed to a bottom panel and a pair of side panels opposed to one another and extending between ends of the top and bottom panels, respectively. The insert portion defines an interior area and the top, bottom, and side panels have inner surfaces, respectively, that define a plurality of grooves spaced apart from one another, respectively. A plurality of primary panels includes upper and lower edges, respectively, selectively received in the plurality of grooves of the top and bottom panels, respectively, each primary panel having an inner edge defining a plurality of slots extending away from the inner edge.

The system includes a plurality of auxiliary panels, each auxiliary panel having an outer edge defining a slot extending away from the outer edge, respectively, for mating with a respective slot defined by an inner edge of a primary panel, respectively. A plurality of pegboard panels are attached to inward edges of the top, bottom, and side panels, respectively, the plurality of pegboard panels defining a plurality of spaced apart holes suitable for hanging articles.

Therefore, a general object of this invention is to provide a modular organization system for insertion into a piece of luggage, namely, a suitcase.

Another object of this invention is to provide a modular organization system, as aforesaid, that may be inserted into a suitcase and assembled into a plurality of partitions, shelves, and the like, for separating clothing types.

Still another object of this invention is to provide a modular organization system, as aforesaid, that enables clothing to be separated and made accessible merely be orienting an assembled suitcase upright in the manner of a clothes dresser or closet.

Yet another object of this invention is to provide a modular organization system, as aforesaid, that is easy to assemble and easy to store when not in use.

A further object of this invention is to provide a modular organization system, as aforesaid, that is adaptable for use in suitcases of different sizes and dimensions.

Other objects and advantages of the present invention will become apparent from the following description taken in connection with the accompanying drawings, wherein is set forth by way of illustration and example, embodiments of this invention.

BRIEF DESCRIPTION OF THE DRAWINGS

FIG. 6*b* is a fully exploded view of the modular organization system as in FIG. 6*a;*

DESCRIPTION OF THE PREFERRED EMBODIMENT

Figure 1A:
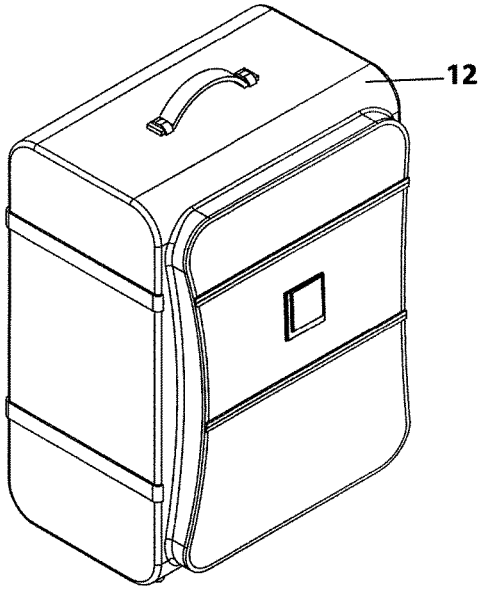
FIG. 1*a* is a perspective view of a suitcase in a closed configuration.

A modular organization system according to a preferred embodiment of the present invention will now be described with reference to FIGS. 1 to 10 of the accompanying drawings. The modular organization system 10 includes an insert portion 20, a plurality of primary panels 30, a plurality of auxiliary panels 40, a plurality of shelf panels 54, and a mesh container 60.

The modular organization system 10 includes a plurality of panels and, more particularly, at least three different types of panels that may be assembled together within the confines of an insert portion 20 and positioned in the interior area of a suitcase 12. The three types of panels enable the modular organization system 10 to take various shapes and dimensions so as to be useful with suitcases of a myriad of sizes and configurations. It should be appreciated, however, that the present invention is modular and selectable by a user and is not multiple embodiments or different inventions. In other words, each type of panel is the same in every selectable assembly as will be understood below.

The insert portion 20 provides a frame or framework that for receiving an assembly of the various panels. In other words, an assembly of the plurality of panels is received and mounted securely inside the insert portion 20 as will be described in more detail below. The insert portion 20 includes a top panel 22 having a planar configuration and having opposed ends. The insert portion 20 includes a bottom panel 24 opposite and parallel to the top panel, the bottom panel 24 also having a planar configuration and having opposed ends. The insert portion 20 includes a pair of side panels 26 opposed and parallel to one another extending between ends of the top and bottom panels, respectively.

Figure 2:
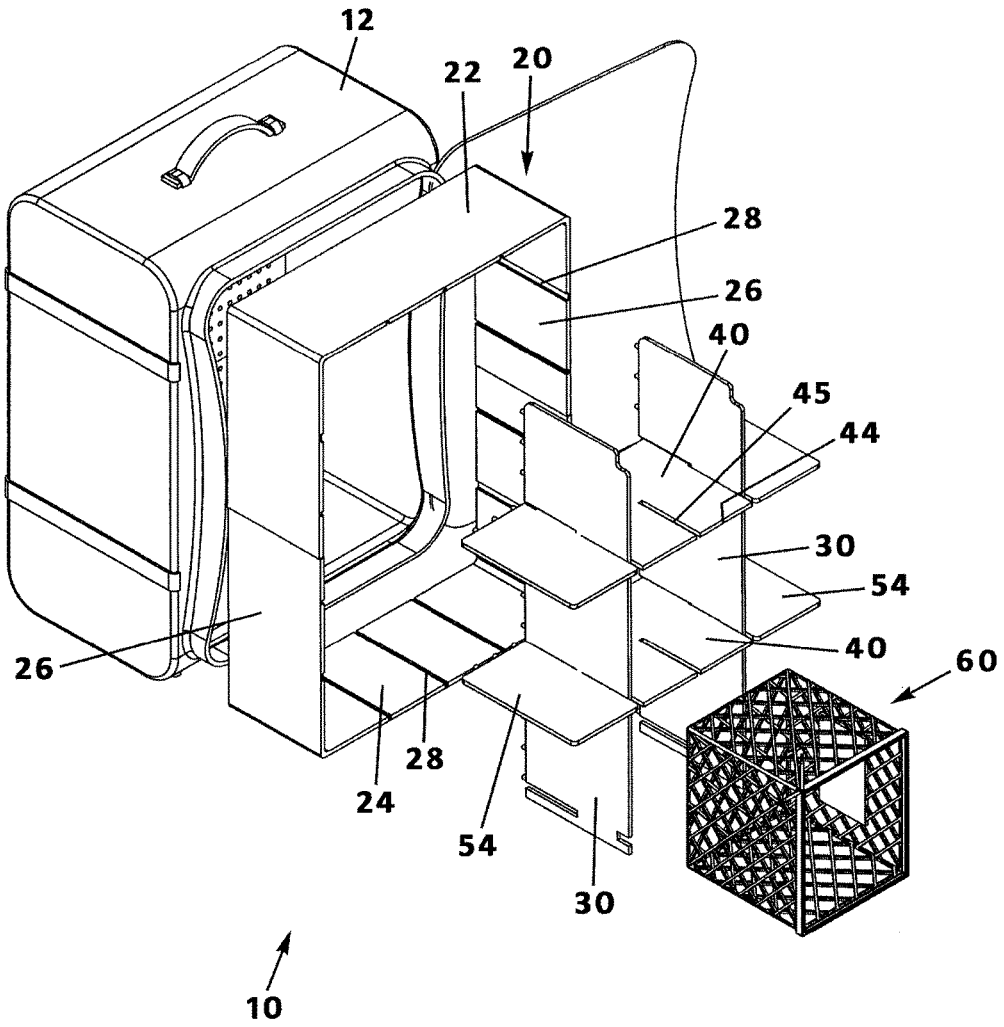
FIG. 2 is an exploded view of the modular organizational system as in FIG. 1*b;*

Further, and as shown in FIG. 2, the side panels 26 may include multiple portions and may, in some embodiments, be length adjustable so that the insert portion 20 may be sized to fit into the interior of different size suitcases. In addition, each of the top, bottom, and side panels of the insert portion 20 include inner surfaces that define a plurality of grooves 28, respectively. The grooves 28 may be spaced apart from one another and sized appropriately to receive respective edges of the primary panels 30, auxiliary panels 40, and shelf panels 54, such as in a slidable manner.

The modular organization system 10 includes a plurality of primary panels 30, each primary panel 30 having an elongate and generally planar configuration. End edges of respective primary panels 30 may be slidably coupled to or received into respective grooves 28 defined by respective top 22 and bottom 24 panels of the insert portion 20. In use, the primary panels 30 may be spaced apart from one another and extend between the top and bottom panels with respective auxiliary panels 40 and shelf panels 54 being attached thereto. In addition, each primary panel 30 has an inner edge 32 defining at least one slot and preferably a plurality of slots 34. Preferably, the slot 34 extends away from the inner edge 32 but does not extend all the way to an opposed outer edge 36.

Figure 6A:
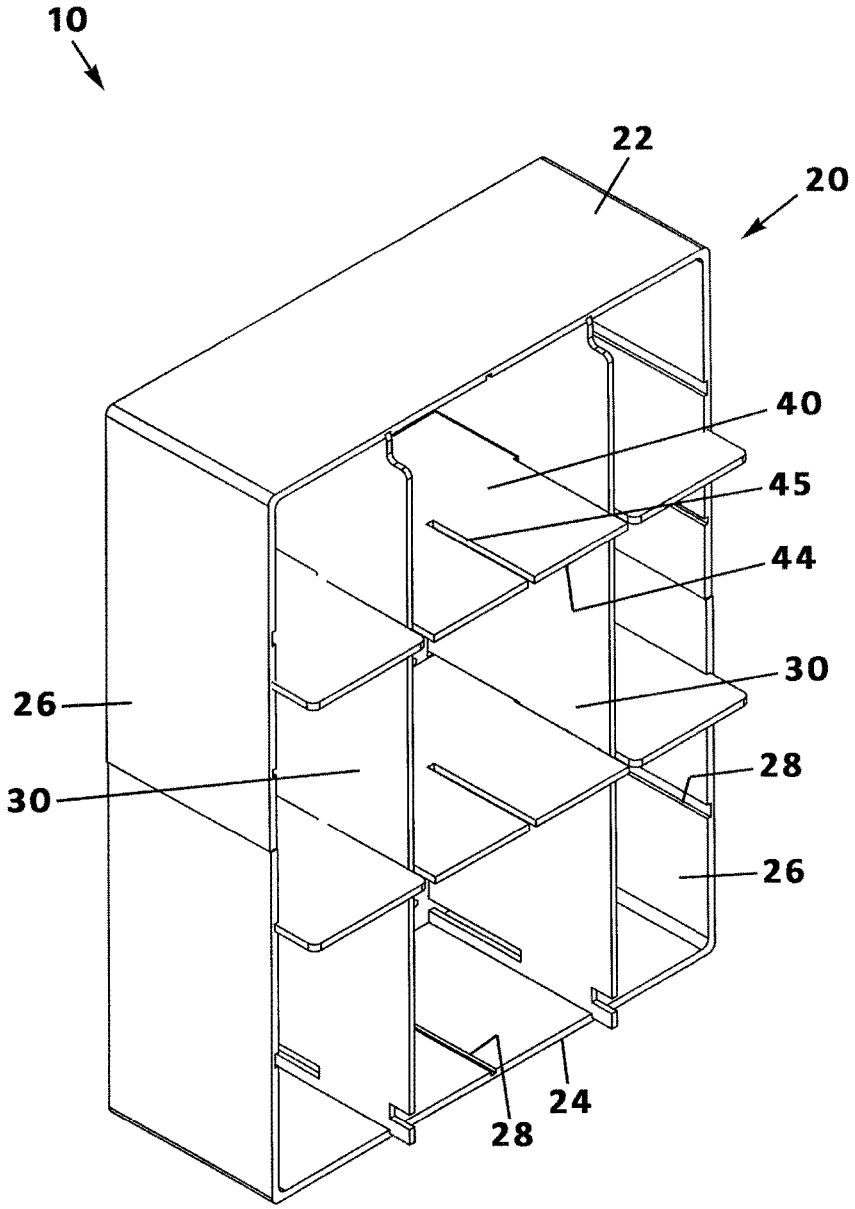
FIG. 6*a* is a perspective view of the modular organization system with the components thereof assembled in another arrangement.
Figure 6B:
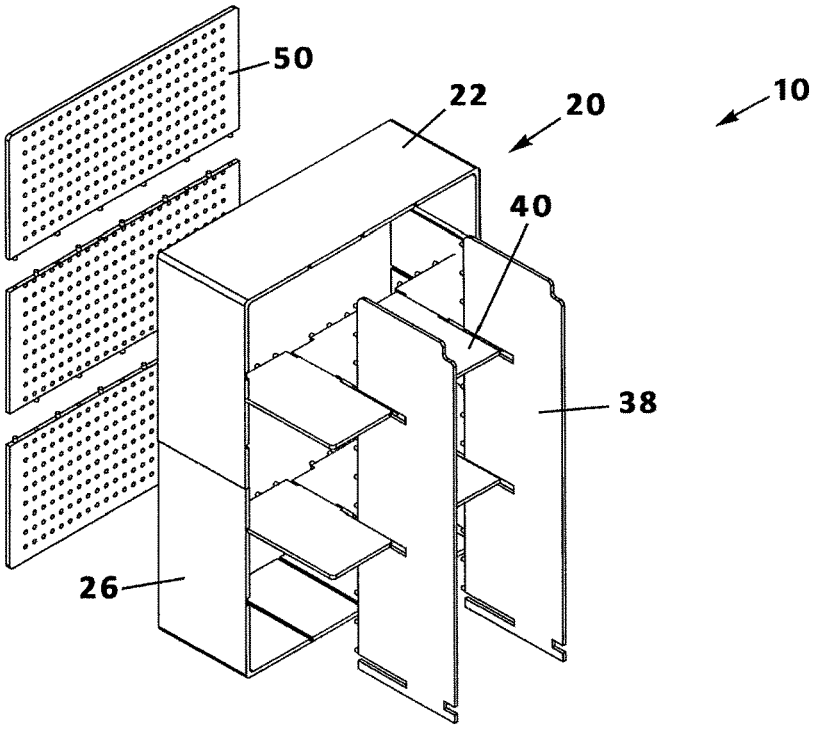
FIG. 6*b* is a partially exploded view of the modular organization system as in FIG. 6*a;*

The modular organization system 10 includes a plurality of auxiliary panels 40, each auxiliary panel 40 having a generally planar configuration and forms an opposed inner edge 42 and outer edge 44 with connecting side edges 46. The outer edge 44 defines a slot 45 extending inwardly away from and perpendicular to the outer edge 44. The slot 45 of the outer edge 44 of the auxiliary panel 40 is complementary to and may be selectively and slidably coupled to or engaged with a respective slot 45 of a primary panel 30 (FIG. 6*b*). In use, the combination of slots allows a user more options on how the modular organizational system is assembled as shown in the accompanying drawings.

In another aspect, the modular organization system 10 includes a pegboard panel 50 attached to respective inner edges of at least one of the top, bottom, or side walls of the insert portion. Preferably, the pegboard panel 50 is coupled to more than one of the inner edges described above. It is understood that the pegboard panel 50 may cover an entirety of an open rear of the insert portion 20 or a plurality of pegboard panels may be included that, together, covers an entirety of the rear of the insert portion 20. The pegboard panel 50 defines a plurality of spaced apart holes 52 that are each configured to receive a peg of the primary, auxiliary, and shelf panels or another hanging fastener or article.

Figure 6C:
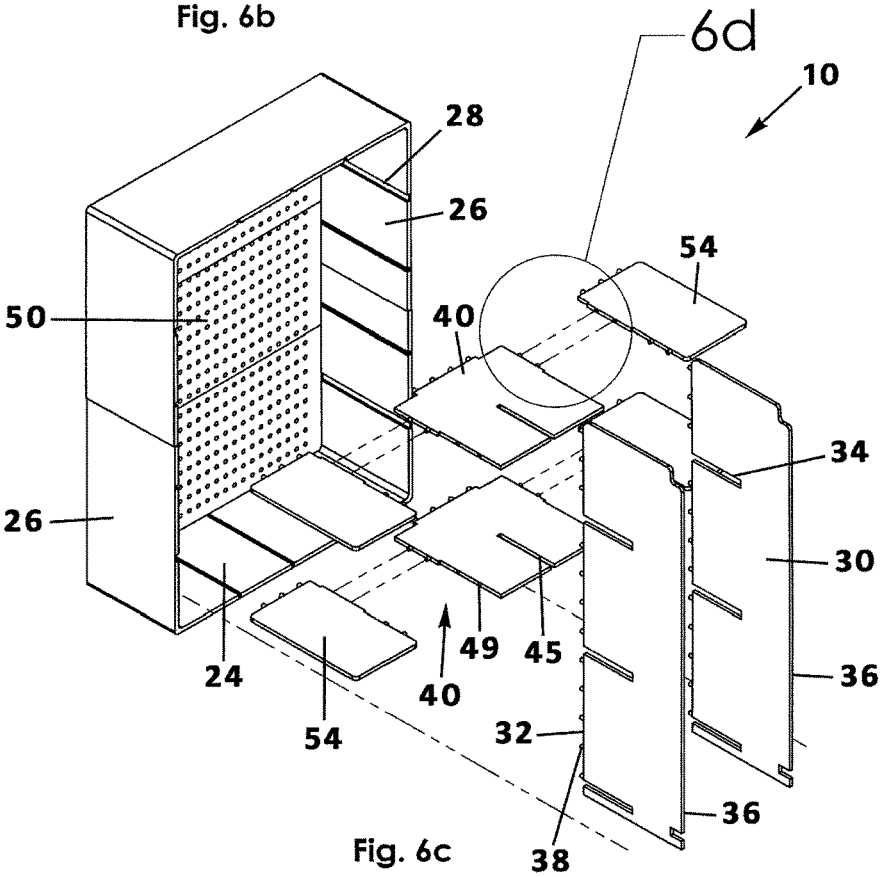
FIG. 6*d* is an isolated view on an enlarged scale taken from FIG. 6*c;*
Figure 7:
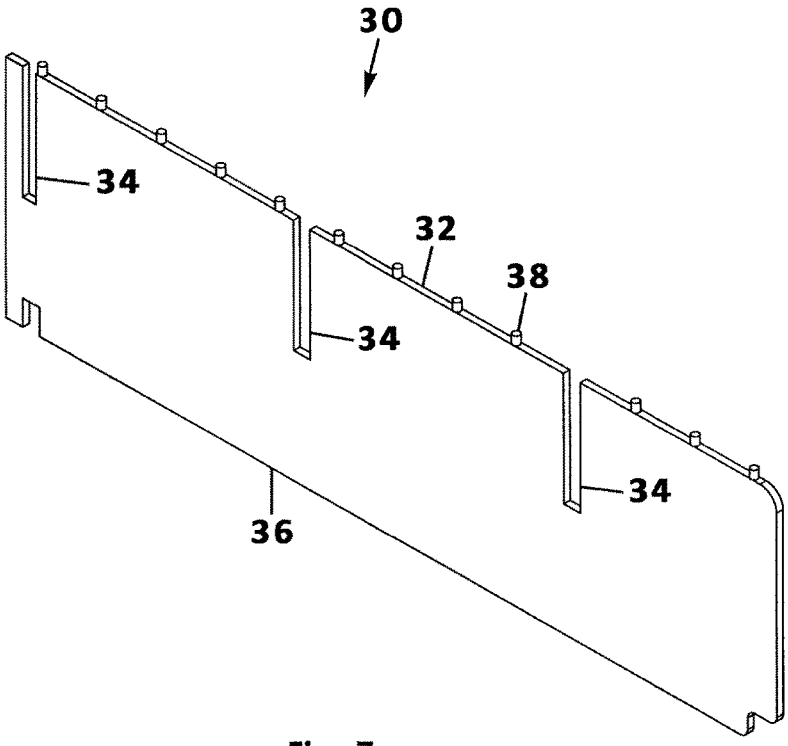
FIG. 7 is an isolated perspective view of a primary panel according to the present invention.
Figure 8:
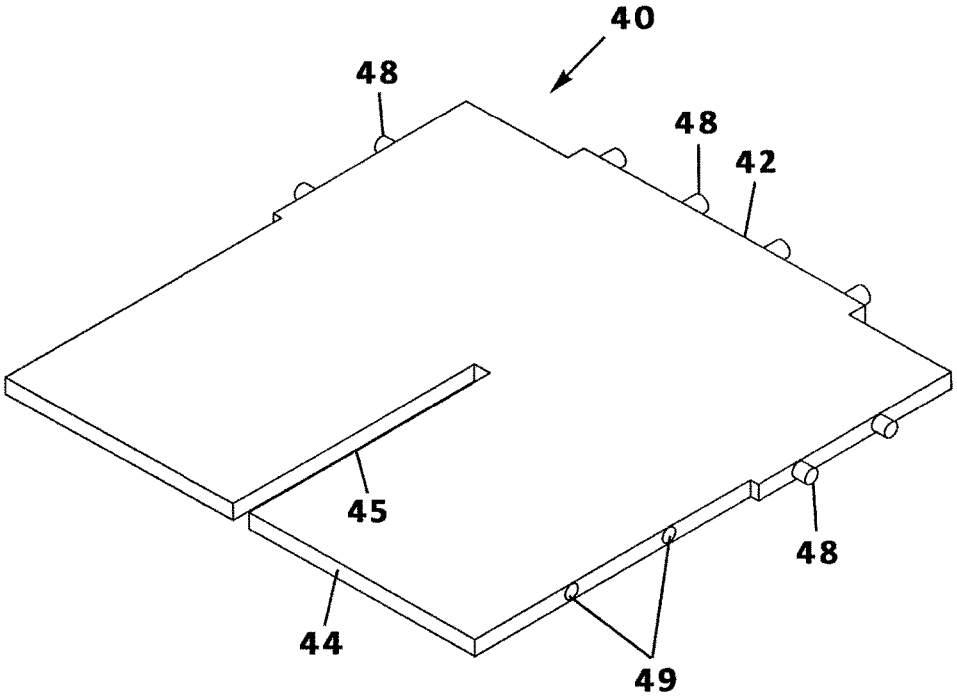
FIG. 8 is an isolated perspective view of an auxiliary panel according to the present invention.

Each primary panel 30 includes an inner edge 32 and a plurality of pegs 38 are spaced apart therealong and extend outwardly (FIG. 7). Each peg 38 has a shape and size that is selectively and removably received into respective holes 52 in the pegboard panel 50 (FIG. 6*c*). Therefore, each primary panel 30 may be positioned by slidable insertion into respective grooves 28 and by insertion of said plurality of pegs 38 into respective holes 52 of said pegboard panel 50.

Similarly and with further reference to the plurality of auxiliary panels 40, each auxiliary panel includes a plurality of pegs 48 extending away from an inner edge thereof and being laterally spaced apart. The pegs 48 extending from an inner edge 42 of an auxiliary panel 40 are selectively received into respective holes 52 defined by the pegboard. Similarly, a plurality of pegs 48 extends away from each of the pair of side edges 46 of an auxiliary panel 40. In addition, each side edge 46 of an auxiliary panel 40 may also define one or a plurality of holes 49 configured to selectively receive pegs associated with another auxiliary panel 40 such as a laterally adjacent auxiliary panel 40.

Figure 6D:
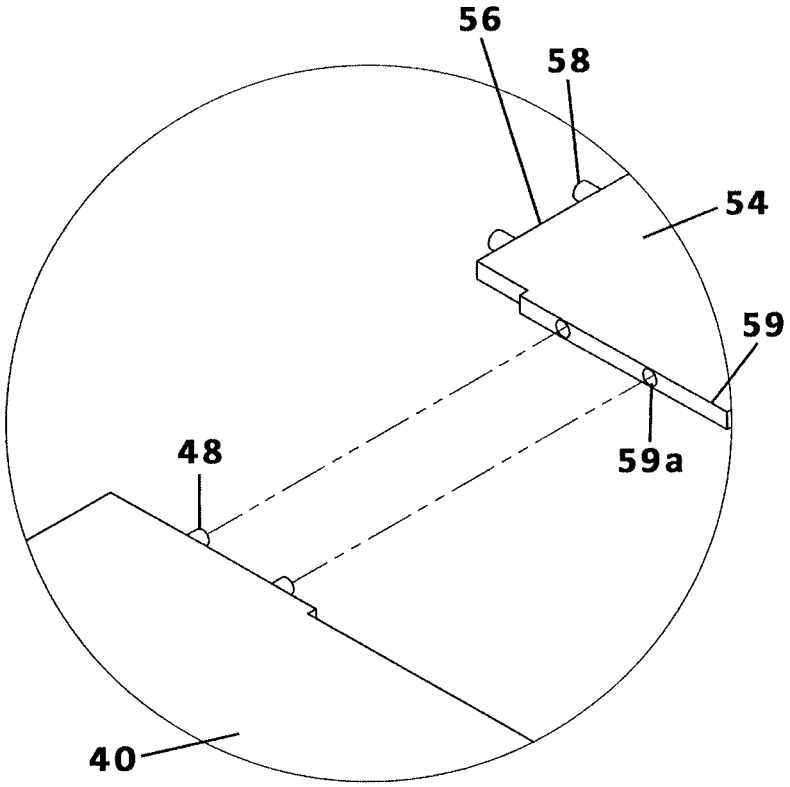
Figure 9:
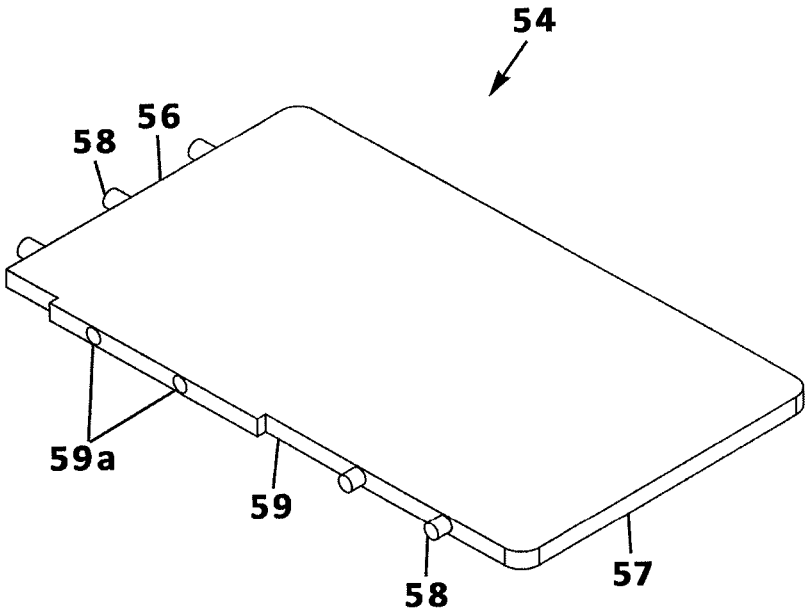
FIG. 9 is an isolated perspective view of a shelf panel according to the present invention.

In another aspect, the modular organization system 10 includes a plurality of shelf panels 54, each shelf panel 54 having a planar configurations, opposed inner and outer edges 56, 58, and opposed side edges 59 perpendicular to the inner and outer edges, respectively (FIG. 9). Each shelf panel 54 also includes a plurality of pegs 58 extending away from the inner edge 56 thereof and are dimensioned to be removably received in respective holes defined by the pegboard panel 50. Further, pegs 58 extend from at least one side edge for selective receipt by respective holes 52 of an auxiliary panel 40. Similarly, respective pegs 48 of an auxiliary panel 40 may be received into corresponding holes 59*a* of a shelf panel 54 (FIG. 6*d*).

Figure 10:
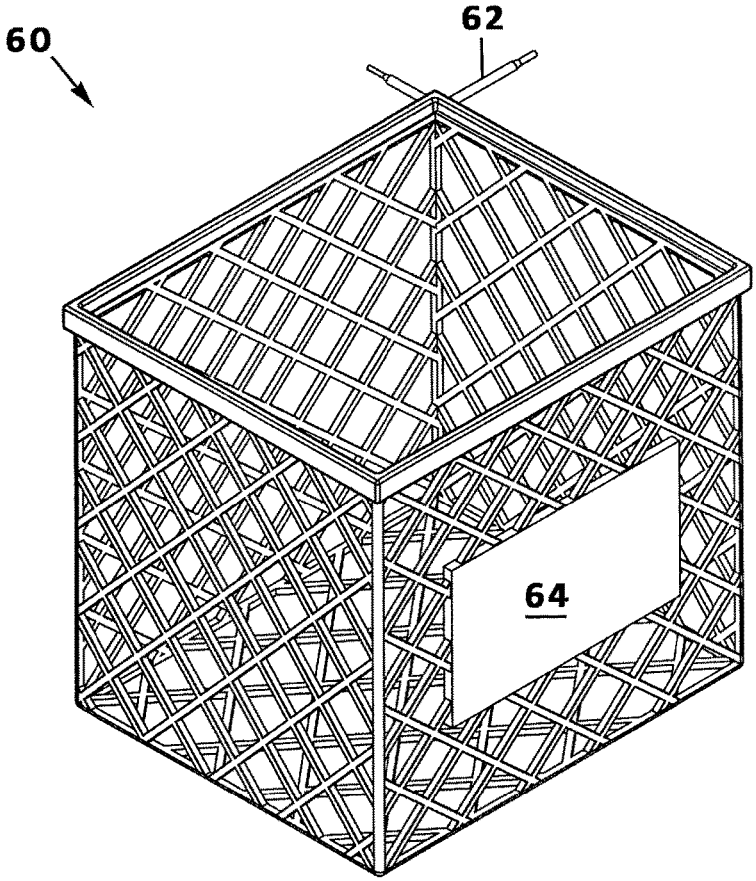
FIG. 10 is an isolated perspective view of a mesh laundry container according to the present invention.

In yet another aspect, the modular organization system 10 includes a laundry container 60 having continuous wall construction that defines an open top and interior area (FIG. 10). Preferably, the laundry container 60 is constructed of a flexible mesh material so that the laundry container 60 may be inserted into an area between respective panels when assembled as described above. The laundry container 60 may include a pull-tie cord 62 extending about the open top and configured to be tightened to pull the top closed or loosened to allow the open top to be opened for access to the interior area. In addition, the laundry container 60 may include one or panels having a smooth surface for receiving indicia such as logo's, brand names, or advertising. In use, the laundry container 60 may be opened for insertion of dirty clothing and then tightened to the closed configuration.

Figure 1B:
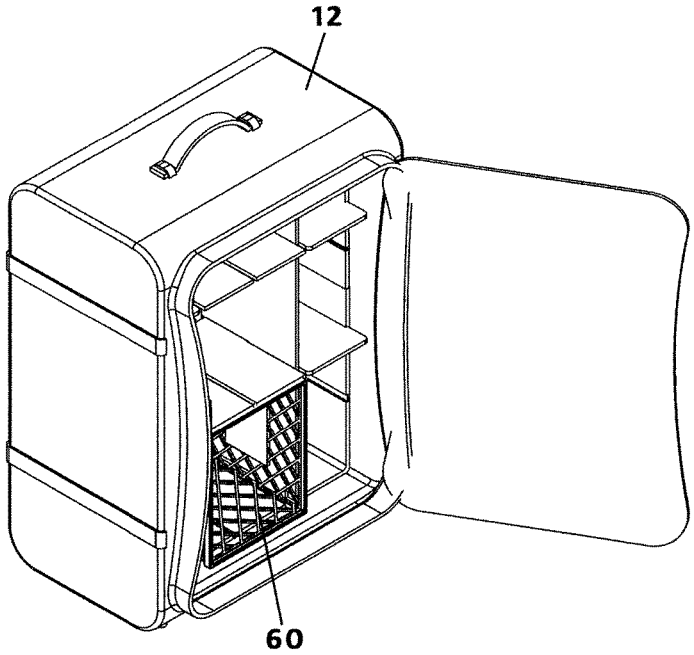
FIG. 1*b* is a perspective view of the suitcase as in FIG. 1 illustrated in an open configuration with a modular organizational system in use therein according to a preferred embodiment of the present invention.
Figure 3A:
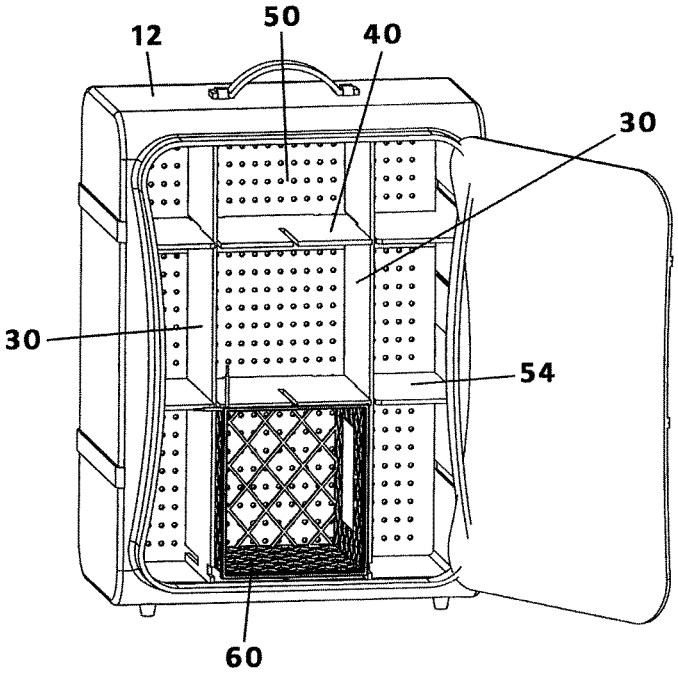
FIG. 3*a* is a front perspective view of the modular organizational system illustrated with the plurality of primary and auxiliary panels assembled in one arrangement.
Figure 3B:
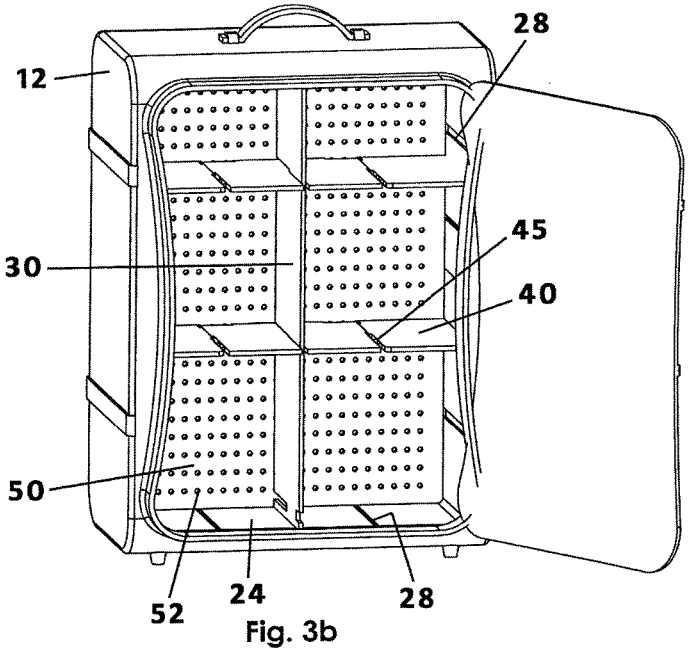
FIG. 3*b* is a front perspective view of the modular organizational system illustrated with the plurality of primary and auxiliary panels assembled in another arrangement.
Figure 3C:
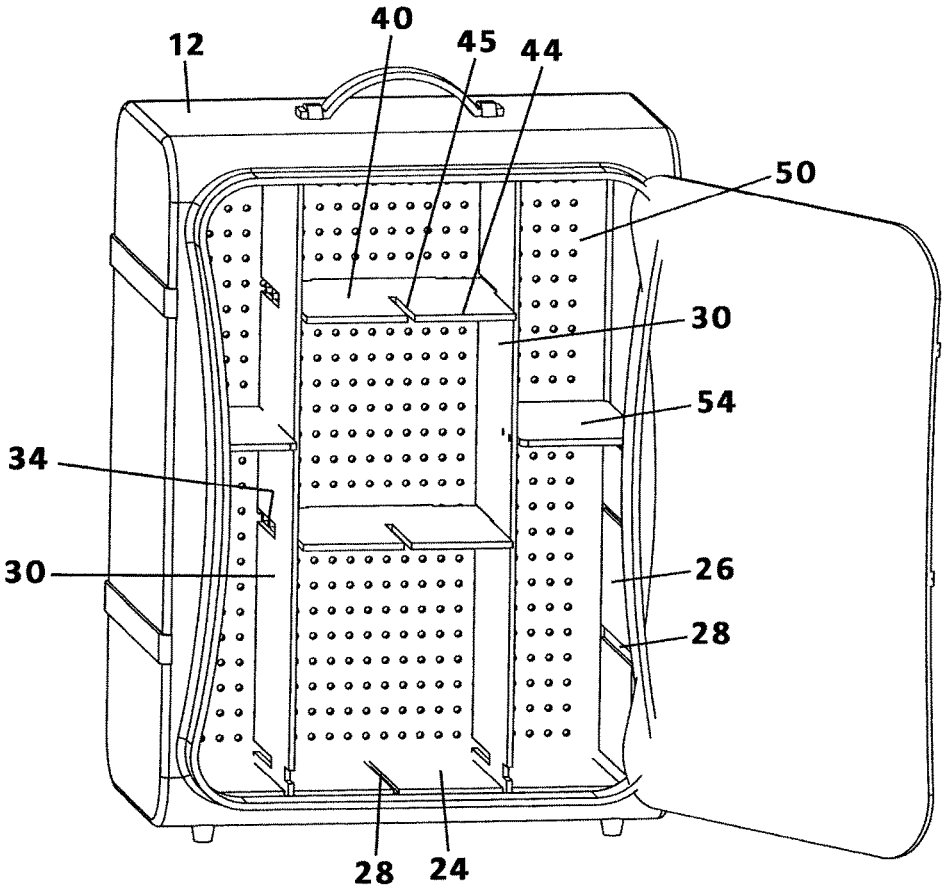
FIG. 3*c* is a front perspective view of the modular organizational system illustrated with the plurality of primary and auxiliary panels assembled in another arrangement.
Figure 4:
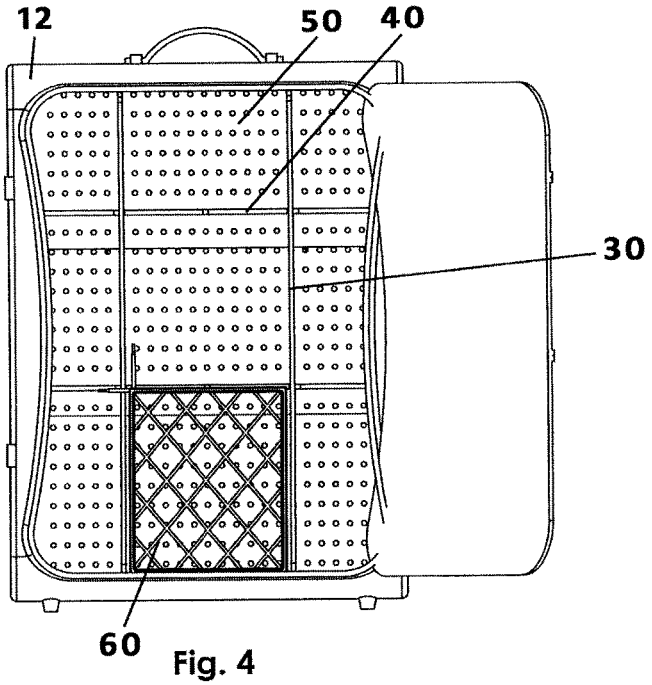
FIG. 4 is a front view of the modular organizational system as in FIG. 3*a;*
Figure 5A:
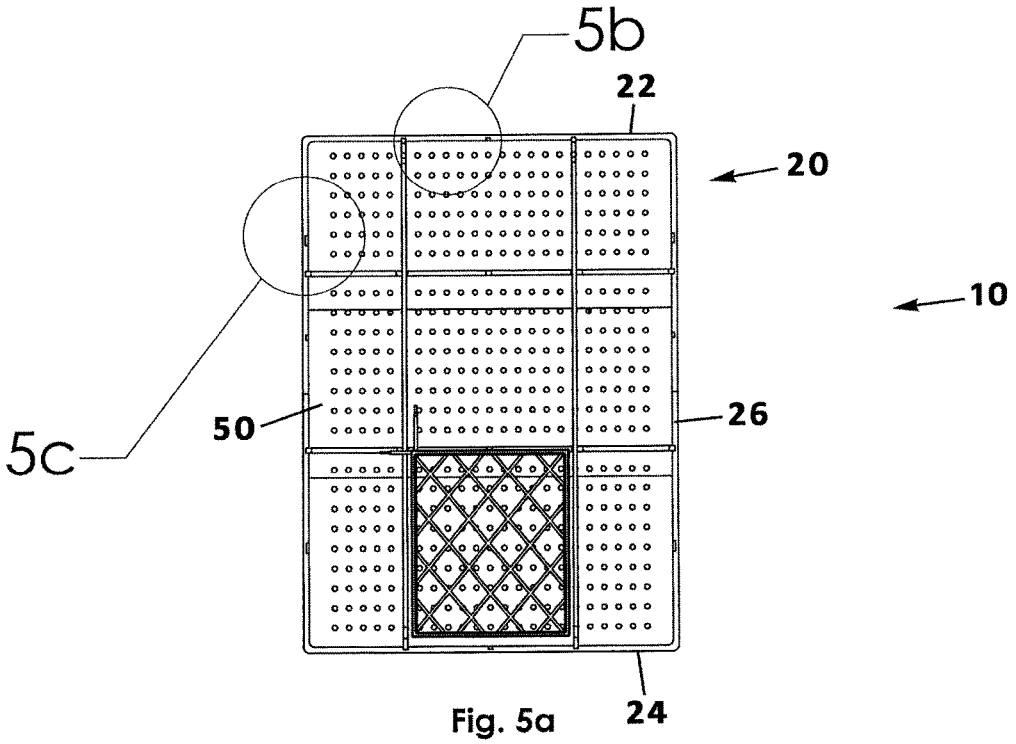
FIG. 5*a* is a front view of the modular organizational system as in FIG. 4 removed from the suitcase for clarity.
Figure 5B:
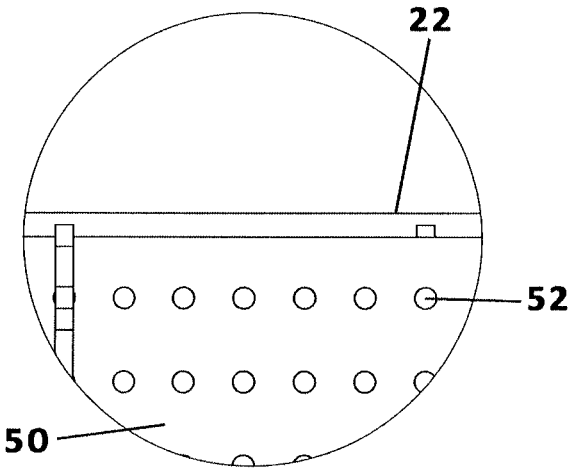
FIG. 5*b* is an isolated view on an enlarged scale taken from FIG. 5*a;*
Figure 5C:
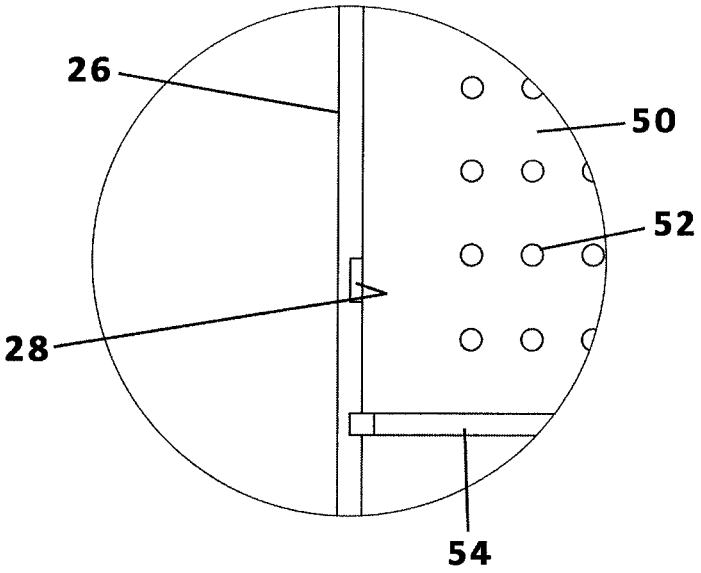
FIG. 5*c* is an isolated view on an enlarged scale taken from FIG. 5*a;*

In use, the insert portion 20 provides a frame or framework for receiving an assembly of the various panels and may itself be inserted into the open area of a suitcase (FIGS. 1*b* and 3*a*). Then, depending on the size of the suitcase and insert portion 20, the various panels of the modular organization system 10 may be assembled and coupled to the insert portion 20. For instance, one primary panel 30 may be inserted and coupled between respective top and bottom panels 22, 24 of the insert portion (FIG. 3*b*). Alternatively, two primary panels 30 may be spaced apart and inserted (FIG. 3*c*). In either instance, auxiliary panels 40 and shelf panels 54 may be inserted and coupled to respective primary panels 30 and to the pegboard panel 50 as described. Clearly, the modular organization system 10 has a modular construction and may be assembled as desired.

With the assembly inserted into the suitcase 12, the suitcase may be packed in an organized manner, i.e. with various articles packed into various compartments defined between panels. For instance, socks may be inserted in one compartment, undergarments in another, toiletries in another, and so on. When a travel destination is arrived at, the suitcase 12 may be situated in an upright orientation, the suitcase front panel may be opened, and the modular organization system 10 may be used in the manner of a dresser or panel of compartments. Accordingly, the contents of the suitcase 12 are organized, easily accessible, and need not be unpacked into dresser drawers.

It is understood that while certain forms of this invention have been illustrated and described, it is not limited thereto except insofar as such limitations are included in the following claims and allowable functional equivalents thereof.

The invention claimed is:

1. A modular organizational system for use in organizing a suitcase, comprising:

an insert portion having a top panel opposed to a bottom panel and a pair of side panels opposed to one another and extending between ends of said top and bottom panels, respectively, the insert portion defining an interior area and said top, bottom, and side panels having inner surfaces, respectively, that define a plurality of grooves spaced apart from one another respectively;

a plurality of primary panels having upper and lower edges, respectively, selectively received in said plurality of grooves of said top and bottom panels, respectively, each primary panel having an inner edge defining a plurality of slots extending away from said inner edge;

a plurality of auxiliary panels, each auxiliary panel having an outer edge defining a slot extending away from said outer edge, respectively, for mating with a respective slot defined by an inner edge of a primary panel, respectively;

a plurality of pegboard panels attached to inward edges of said top, bottom, and side panels, respectively, said plurality of pegboard panels defining a plurality of spaced apart holes suitable for hanging articles; and a container member removably positioned in said insert portion and constructed of a mesh material having a continuous side wall that defines an interior space and an open end, said container member having a draw string for drawing said open end between an open configuration allowing access to said interior space and a closed end not allowing access to said interior space.

2. The modular organizational system as in claim 1, wherein said container member includes an indicia member mounted to said side wall that has a surface that includes one of a logo, a picture, a color, or an alphanumeric indicia.

3. A modular organizational system for use in organizing a suitcase, comprising:

an insert portion having a top panel opposed to a bottom panel and a pair of side panels opposed to one another and extending between ends of said top and bottom panels, respectively, the insert portion defining an interior area and said top, bottom, and side panels having inner surfaces, respectively, that define a plurality of grooves spaced apart from one another, respectively;

a plurality of primary panels having upper and lower edges, respectively, selectively received in said plurality of grooves of said top and bottom panels, respectively, each primary panel having an inner edge defining a plurality of slots extending away from said inner edge;

a plurality of auxiliary panels, each auxiliary panel having an outer edge defining a slot extending away from said outer edge, respectively, for mating with a respective slot defined by an inner edge of a primary panel, respectively; and a pegboard panel attached to an inward edge of at least one of said top, bottom, and side panels, said at least one pegboard panel defining a plurality of spaced apart holes suitable for hanging articles;

wherein:

each of said plurality of primary panels includes a plurality of pegs extending from an inner edge thereof, respectively, that are spaced apart from one another;

said plurality of holes of said pegboard panel selectively receives said plurality of pegs of said inner edge of said primary panel, respectively;

each of said auxiliary panels includes a plurality of pegs extending from an inner edge thereof, respectively, that are spaced apart from one another;

said plurality of holes of said pegboard panel selectively receives said plurality of pegs of said inner edge of said auxiliary panel wherein:

said plurality of auxiliary panels includes a plurality of pegs extending from each of a pair of side edges, respectively;

each of said pair of side edges defines a plurality of peg holes selectively receiving respective pegs associated with a laterally adjacent auxiliary panel.

4. The modular organizational system as in claim 3, further comprising:

a plurality of shelf panels, each shelf panel having a planar configuration and includes an inner edge and a side edge perpendicular to said inner edge;

wherein each shelf panel includes a plurality of pegs extending from said inner edge and that are selectively received in said plurality of holes defined by said pegboard panel;

where each shelf panel includes a plurality of pegs extending from said side edge thereof that are selectively received in said plurality of peg holes of said pair of side edges of said plurality of auxiliary panels.

5. The modular organizational system as in claim 4, wherein:

each auxiliary panel of said plurality of auxiliary panels has a planar configuration and each primary panel of said plurality of primary panels has a planar configuration;

said each auxiliary panel is perpendicular to said each primary panel said slot of said auxiliary panel is coupled to said slot of said primary panel, respectively.

6. The modular organizational system as in claim 5, wherein:

said plurality of primary panels are spaced apart from and parallel to one another;

said plurality of primary panels are perpendicular to said top panel and said bottom panel of said insert portion.

7. The modular organizational system as in claim 4, wherein each shelf panel of said plurality of shelf panels includes an outer edge selectively received in a groove defined by a respective side panel of said insert portion.

8. The modular organizational system as in claim 3, wherein said pegboard panel includes a plurality of pegboard panels attached to said inward edges of said said top, bottom, and side panels, respectively, said plurality of pegboard panels defining said plurality of spaced apart holes suitable for hanging articles.

9. The modular organizational system as in claim 3, further comprising a container member removably positioned in said insert portion and constructed of a mesh material having a continuous side wall that defines an interior space and an open end, said container member having a draw string for drawing said open end between an open configuration allowing access to said interior space and a closed end not allowing access to said interior space.

10. The modular organizational system as in claim 9, wherein said container member includes an indicia member mounted to said side wall that has a surface that includes one of a logo, a picture, a color, or an alphanumeric indicia.

11. A modular organizational system for use in organizing a suitcase, comprising:

an insert portion having a top panel opposed to a bottom panel and a pair of side panels opposed to one another and extending between ends of said top and bottom panels, respectively, the insert portion defining an interior area and said top, bottom, and side panels having inner surfaces, respectively, that define a plurality of grooves spaced apart from one another respectively;

a plurality of primary panels having upper and lower edges, respectively, selectively received in said plurality of grooves of said top and bottom panels, respectively, each primary panel having an inner edge defining a plurality of slots extending away from said inner edge;

a plurality of auxiliary panels, each auxiliary panel having an outer edge defining a slot extending away from said outer edge, respectively, for mating with a respective slot defined by an inner edge of a primary panel, respectively;

a plurality of pegboard panels attached to inward edges of said top, bottom, and side panels, respectively, said plurality of pegboard panels defining a plurality of spaced apart holes suitable for hanging articles; and wherein:

each of said plurality of primary panels includes a plurality of pegs extending from an inner edge thereof, respectively, that are spaced apart from one another;

said plurality of holes of said pegboard panel selectively receives said plurality of pegs of said inner edge of said primary panel, respectively;

each of said auxiliary panels includes a plurality of pegs extending from an inner edge thereof, respectively, that are spaced apart from one another;

said plurality of holes of said pegboard panel selectively receives said plurality of pegs of said inner edge of said auxiliary panel;

wherein:

said plurality of auxiliary panels includes a plurality of pegs extending from each of a pair of side edges, respectively;

each of said pair of side edges defines a plurality of peg holes selectively receiving respective pegs associated with a laterally adjacent auxiliary panel.

12. The modular organizational system as in claim 11, further comprising:

a plurality of shelf panels, each shelf panel having a planar configuration and includes an inner edge and a side edge perpendicular to said inner edge;

wherein each shelf panel includes a plurality of pegs extending from said inner edge and that are selectively received in said plurality of holes defined by said pegboard panel;

where each shelf panel includes a plurality of pegs extending from said side edge thereof that are selectively received in said plurality of peg holes of said pair of side edges of said plurality of auxiliary panels.

13. The modular organizational system as in claim 12, wherein:

each auxiliary panel of said plurality of auxiliary panels has a planar configuration and each primary panel of said plurality of primary panels has a planar configuration;

said each auxiliary panel is perpendicular to said each primary panel said slot of said auxiliary panel is coupled to said slot of said primary panel, respectively.

14. The modular organizational system as in claim 13, wherein:

said plurality of primary panels are spaced apart from and parallel to one another;

said plurality of primary panels are perpendicular to said top panel and said bottom panel of said insert portion.

15. The modular organizational system as in claim 12, wherein each shelf panel of said plurality of shelf panels includes an outer edge selectively received in a groove defined by a respective side panel of said insert portion.

* * * * *